United States Patent [19]

Friar et al.

[11] 4,327,987

[45] May 4, 1982

[54] FILM PROCESSOR

[75] Inventors: Lawrence B. Friar, Yorklyn; Noel H. Kuhrt, Jr., Wilmington, both of Del.; Joel L. Vanover, Elkton, Md.

[73] Assignee: E. I. Du Pont de Nemours and Company, Wilmington, Del.

[21] Appl. No.: 196,342

[22] Filed: Oct. 22, 1980

Related U.S. Application Data

[63] Continuation-in-part of Ser. No. 116,979, Jan. 30, 1980, abandoned.

[51] Int. Cl.[3] ..... G03D 5/04

[52] U.S. Cl. ..... 354/317; 354/325; 118/412; 118/415

[58] Field of Search ..... 354/317, 318, 319, 324, 354/325; 118/412, 415, 660, 407; 134/64 P, 122 P; 355/10

[56] References Cited

U.S. PATENT DOCUMENTS

| | | | |
|---|---|---|---|
| 2,404,138 | 7/1946 | Mayer | 354/325 |
| 3,610,131 | 10/1971 | Frick et al. | 134/64 P |
| 3,635,144 | 1/1972 | Beck | 354/317 |
| 3,643,628 | 2/1972 | Sugarman et al. | 354/317 |
| 3,687,708 | 8/1972 | Miller | 355/10 |
| 3,752,054 | 8/1973 | Scanlan | 354/317 |
| 3,774,521 | 11/1973 | Beck | 354/317 |
| 3,873,988 | 3/1975 | Pfeifer et al. | 354/319 |
| 4,142,194 | 2/1979 | Hamlin | 354/318 |
| 4,145,135 | 3/1979 | Sara | 354/317 |
| 4,148,274 | 4/1979 | Stievenart et al. | 118/660 |

OTHER PUBLICATIONS

Scientific American, "Kitchen-Sink Aerodynamics", C. L. Srong, 1960, pp. 432–438.

*Primary Examiner*—L. T. Hix
*Assistant Examiner*—Alan Mathews

[57] ABSTRACT

An apparatus for processing exposed photosensitive film sheets. A liquid used to develop the images on an exposed element as it is transported through the apparatus flows from a trough located above the path of transport. The liquid passes through a screen as it is introduced to and as it flows from the trough.

10 Claims, 11 Drawing Figures

FILM PROCESSOR

CROSS REFERENCE TO RELATED APPLICATION

This application is a continuation-in-part of Application Ser. No. 116,979, filed Jan. 30, 1980, now abandoned, in the names of Lawrence B. Friar et al.

BACKGROUND

This invention relates generally to the use of photosensitive imaging systems and, more particularly, to the high speed development of photosensitive film sheets bearing latent images.

Equipment for achieving an acceptable density level while processing photosensitive film sheets rapidly is known and available. In an early stage of its development, one of the limiting factors on the speed of processing was the time required to dry a film sheet that had been immersed in the processing liquids, for example, in developing and fixing tanks. Meanwhile, rapid access in the development of film sheets has been achieved by preheating the developing liquids and applying them to an element from nozzles or so-called dribble bars. Although these and analogous modes of application have yielded acceptable density levels in reduced access periods, the final product oftentimes exhibits both longitudinal and transverse nonuniformities and overall patterns of irregular development.

DISCLOSURE OF INVENTION

Worthwhile improvements in uniformity of development have been achieved in an apparatus that includes rolls for transporting an exposed film sheet through at least one section where a processing liquid is applied. A distribution bar delivers the liquid to a trough located above the path of transport and the trough has one edge lower than the other. A foraminous sheet extends lengthwise of the trough beneath the bar. Liquid passes through the foraminous sheet as it enters and as it flows from the trough. A ramp projects downwardly from the trough and terminates in close proximity to the path of transport.

DESCRIPTION OF DRAWINGS

In the accompanying drawings.

DESCRIPTION OF APPARATUS

Imaging systems that can be processed with the apparatus disclosed herein are in the form of a photosensitive film sheet which, upon exposure to actinic radiation, undergoes a chemical or physical change in exposed areas. The film sheets may be silver halide photographic materials or supports coated with photohardenable or photopolymerizable layers. The supports may be paper, plastic or even metal sheets that have been rendered photosensitive by incorporating or coating thereon a substance sensitive to actinic radiation.

Figure 1:
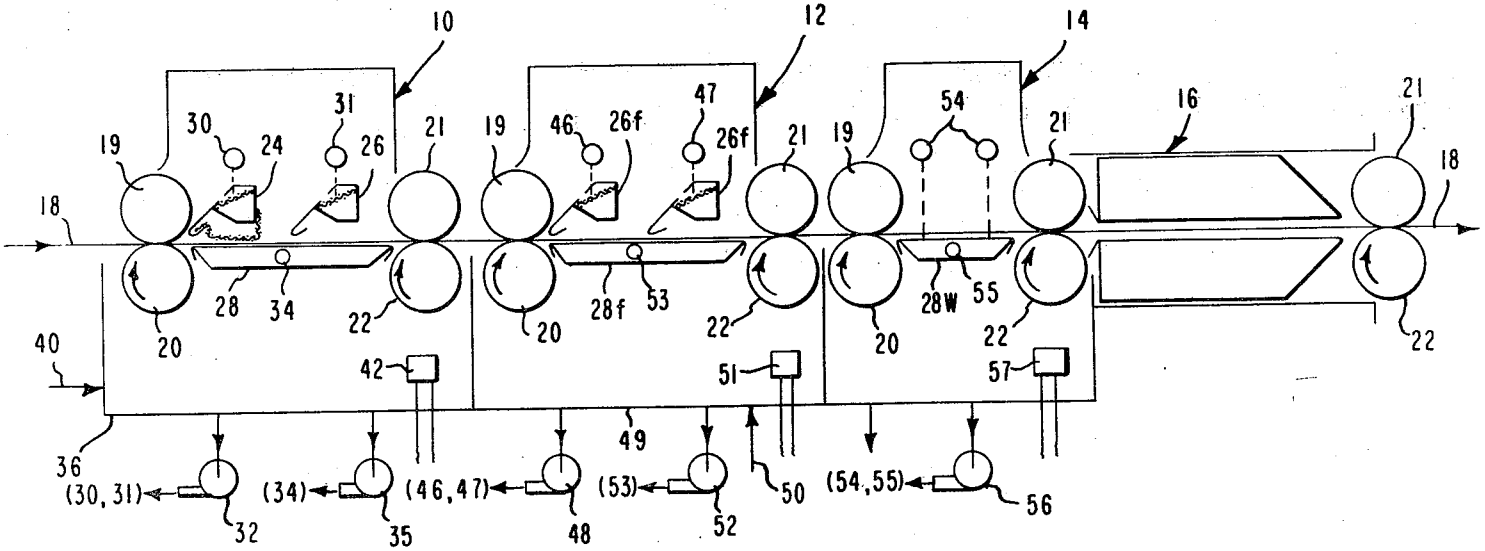
FIG. 1 is a schematic of a processor incorporating the improvements of the present invention.

The processing apparatus shown in FIG. 1 has coupled developing, fixing, washing and drying sections 10, 12, 14, 16. A photosensitive film sheet such as a sheet of exposed silver halide film is advanced through the apparatus, in a horizontal path 18, by driven nip roll pairs. Sections 10, 12, 14 have entry rolls 19,20 and exit rolls 21,22. Drying section 16 has exit rolls 21,22.

In section 10, there are two applicators 24,26 above and a pan 28 below path 18. Applicators 24,26 receive a developing solution from perforated dribble bars 30,31 that are connected to the output of a pump 32. Pan 28 receives solution through a conduit 34 that is connected to a pump 35. Overflows from applicators 24,26 and pan 28 are collected by a tank 36. The solution is replenished through a conduct 40 and maintained at the desired temperature by a device 42.

There are two applicators 26f in section 12. The applicators receive a fixer solution from dribble bars 46,47 that are fed by a pump 48. Pump 48 takes suction on a tank 49. Tank 49 can be replenished with fixer concentrate through a conduit 50 and its contents can be maintained at the desired temperature by a device 51. A pan 28f receives solution from tank 49 through a pump 52 and a conduit 53. Dribble bars 30,31,46,47 have perforations p (FIG. 2) and have been fabricated from tube stock of chlorinated polyvinyl chloride.

In section 14, a film sheet advancing from fixer section 12 is flushed with wash water from dribble bars 54 and its back side is washed with water in a pan 28w. Bars 54 and a conduit 55 connected to pan 28w are supplied by a pump 56 and/or with tap water. Where pump 56 is used, the water can be maintained at the desired temperature by a device 57. The washed film sheet then passes through dryer 16.

Figure 2:
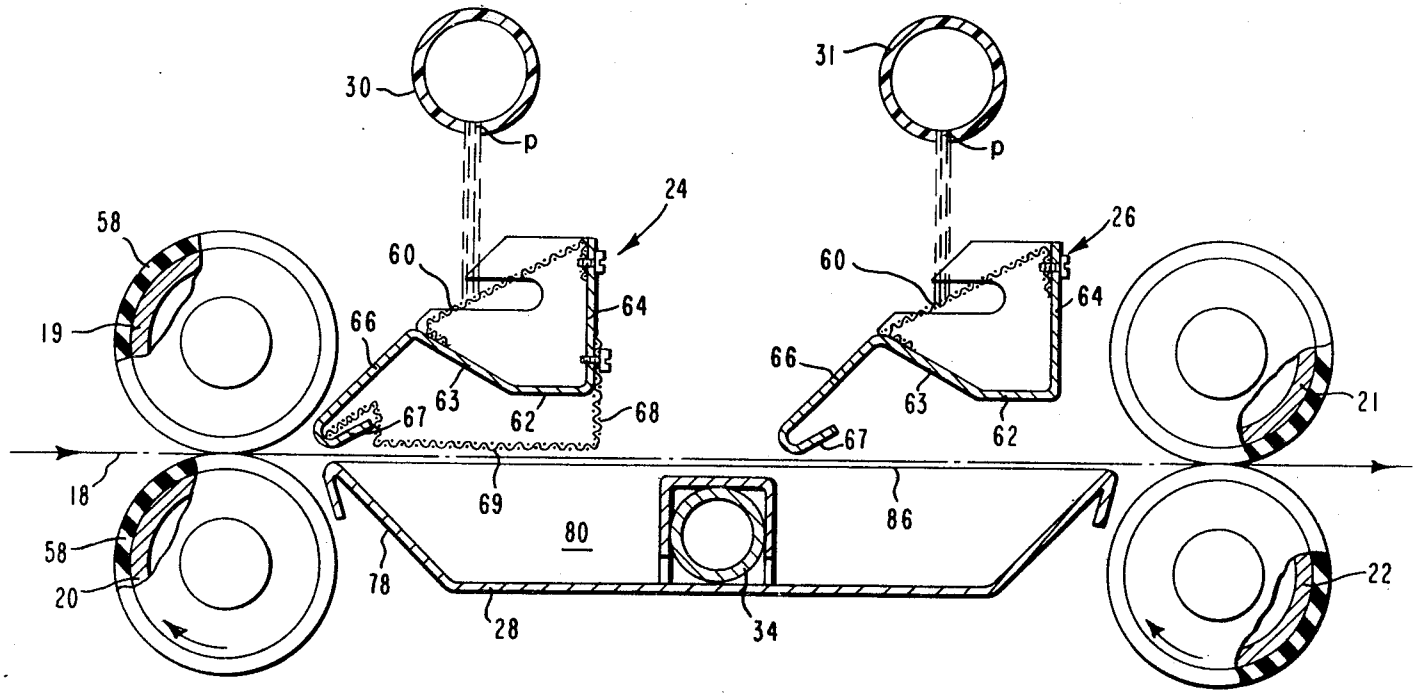
FIG. 2 is a sectional illustration of the liquid applicators in the first section of the processor shown in FIG. 1.

Referring now to FIG. 2, it will be seen that rolls 19-22 carry elastomeric sleeves 58. Applicators 24,26 each have a screen 60 fitted into the mouth and extending from edge-to-edge of an elongated trough 62. Each screen 60 extends lengthwise of trough 62 and has its longitudinal edges folded inwardly to present tabs that engage inner surfaces of front and back walls 63,64. One tab is fastened to the back wall 64. The lip along the top of wall 63 is below the upper edge of wall 64. An integral extension of front wall 63 forms a ramp 66 that projects downwardly into close proximity with path 18. Ramp 66 is bent on itself to present a rounded lip and a terminal flap 67. Ramp 66 is bent on itself to present a rounded lip and a terminal flap 67. Ramps 66 on applicator 24 and the first applicator 26f in section 12 also project into close proximity with the adjacent idler rolls 19.

Additionally, applicator 24 is provided with a screen 68 that has one longitudinal edge fastened to back wall 64 and the opposed edge wedged in the gap between flap 67 and ramp 66. Intermediate its edges, screen 68 has a planar portion 69 that is parallel to and disposed closely adjacent path 18. Foraminous sheets 60,68 have been cut and formed from 60 mesh stainless steel screening.

Figure 3:
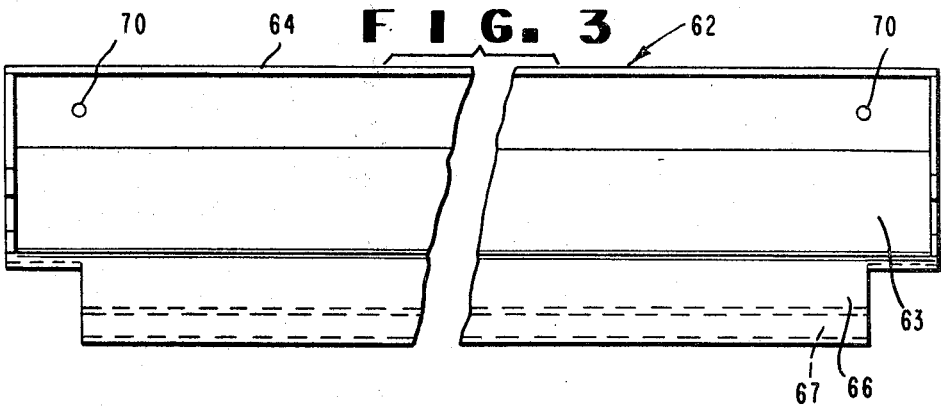
FIGS. 3 and 4 are top and front views, respectively, of the troughs shown in FIG. 2.
Figure 4:
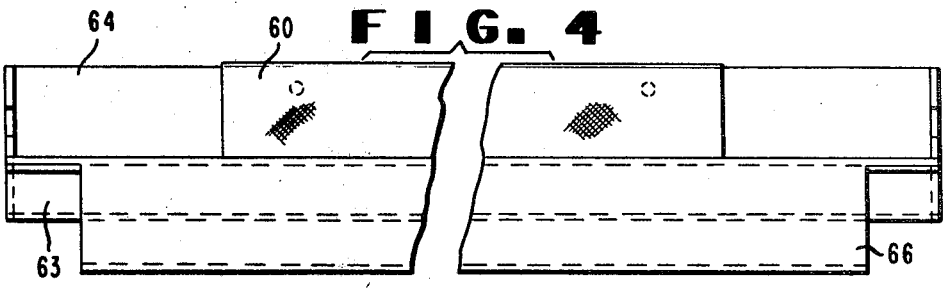

As shown in FIGS. 3 and 4, ramp 66 is shorter than front wall 63 of trough 62 and screen 60 is shorter than the ramp. The bottom wall of the trough has drain holes 70 located beyond the ends of screen 60. In these respects, screen 60 extends beyond the edges of path 18, i.e., is longer than the width of a film sheet to be processed.

Figure 5:
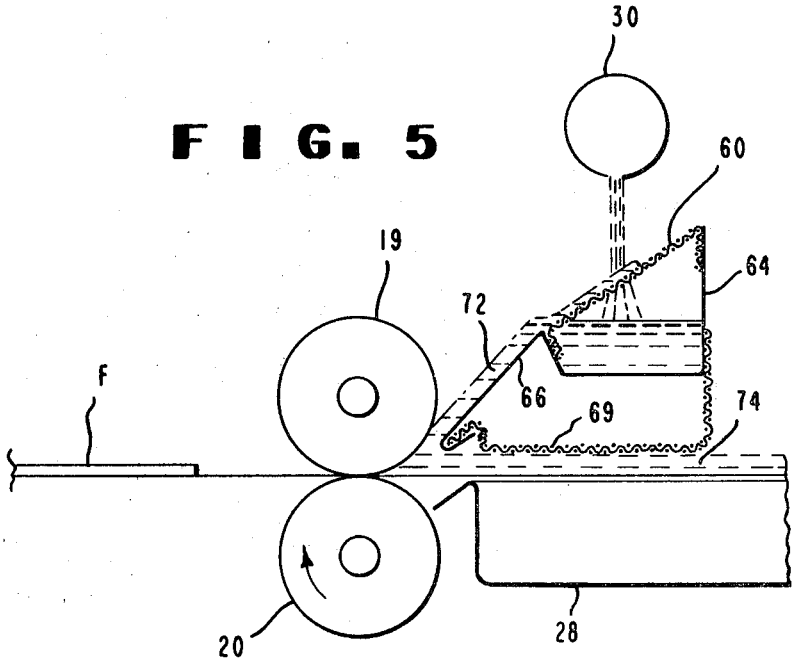
FIG. 5 is a schematic showing the flow of liquid from the first applicator in FIG. 2.
Figure 6:
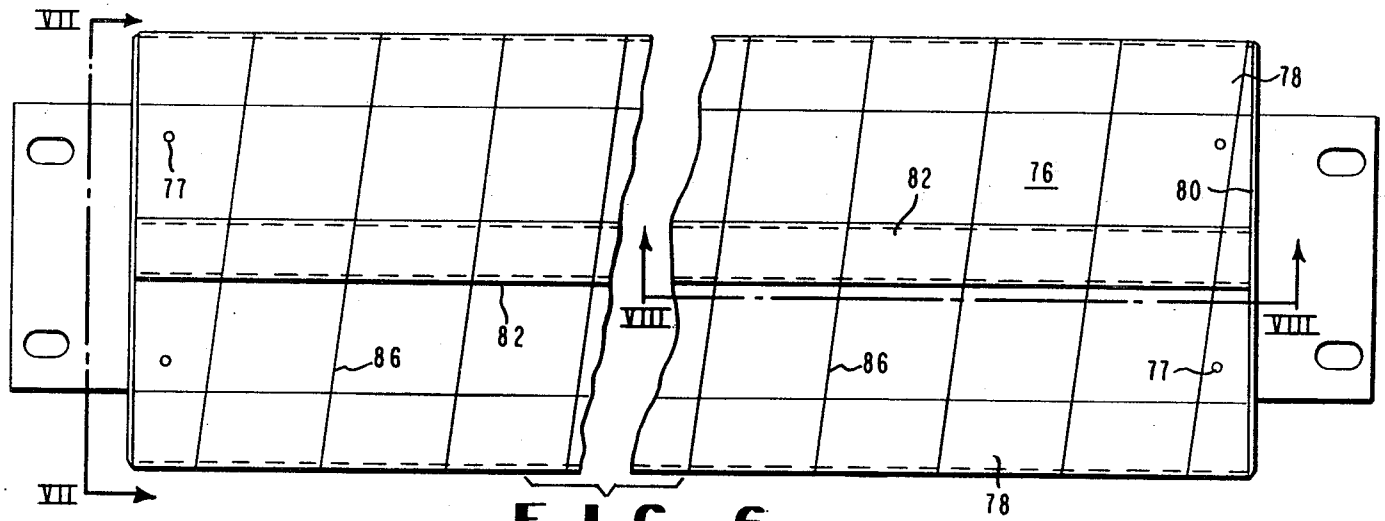
FIGS. 6 and 7 are top and end views, respectively, of the pan shown beneath the path of transport in FIGS. 1 and 2, FIG. 7 having been taken on line VII—VII in FIG. 6.
Figure 8:
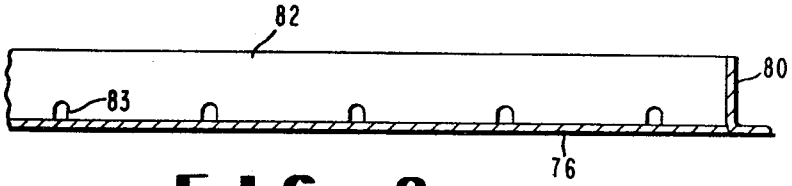
FIG. 8 is a sectional illustration on line VIII—VIII in FIG. 6.
Figure 7:
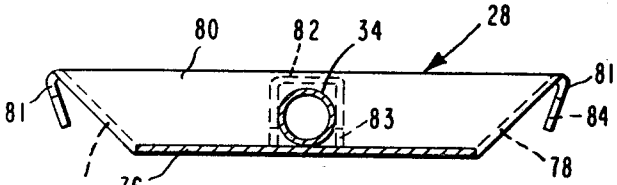
Figure 9:
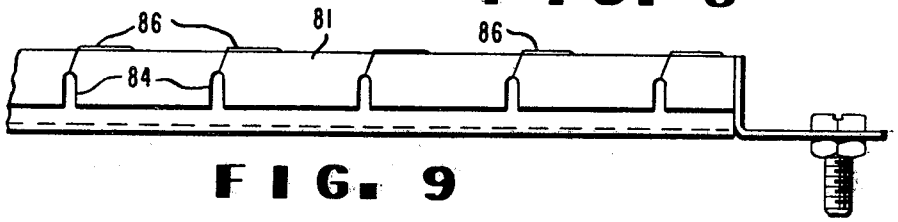
FIG. 9 is a fragmentary front view of the pan.

As shown in FIG. 5, a film sheet F can be inserted into the nip between rolls 19,20 and then advanced over pan 28. Beforehand, pumps 32,35 (FIG. 1) and device 42 will have been activated. Developing solution is pumped to bar 30 and pan 28 to the point where trough 62 and the pan overflow. Some of the solution from bar 30 flows down screen 60 to ramp 66 but mostly the solution passes through the screen and overflows into a layer 72 on ramp 66. Layer 72 falls as a curtain from the gap between idler roll 19 and the bottom of ramp 66 until film sheet F reaches that point. Then, as shown at 74, a pool forms on the film sheet. The liquid in the pool 74 flows over the edges of film sheet F to pan 28 or directly to the bottom of tank 36. Screen portion 69 tends to level pool 74 by spreading it away from the center toward the edges of the film sheet. This spreading action coupled with the motion of film sheet F agitates the solution and further enhances the development of images. In these respects, it should be noted that the distance between film sheet F and screen portion 69 is only about half the distance between roll 19 and the lip at the bottom of ramp 66.

Referring to FIGS. 1, 2 and 6–9, it will be seen that pan 28 extends from a point near roll 20 in section 10 to a point near roll 22. The pan has a bottom wall 76, angularly disposed end walls 78 and side walls 80. Bottom wall 76 has drain holes 77. The end walls have projecting portions 81 that are bent back to present lips. Conduit 34 is connected to one of the side walls 80 and discharges to a distribution housing 82 having a top wall and side walls. Liquid flows from housing 82 through perforations 83, fills pan 28 and overflows the lips at the ends of the pan.

Projections 81 of walls 78 have spaced notches 84 through which a thread 86 of wire or other material such as nylon is laced with the lengths between walls 78 disposed at an acute angle with respect to walls 80. The ends of thread 86 are fastened or anchored in outermost notches. Extending from lip-to-lip of the pan, the thread lengths provide a support for a film sheet being transported along path 18.

Figure 10:
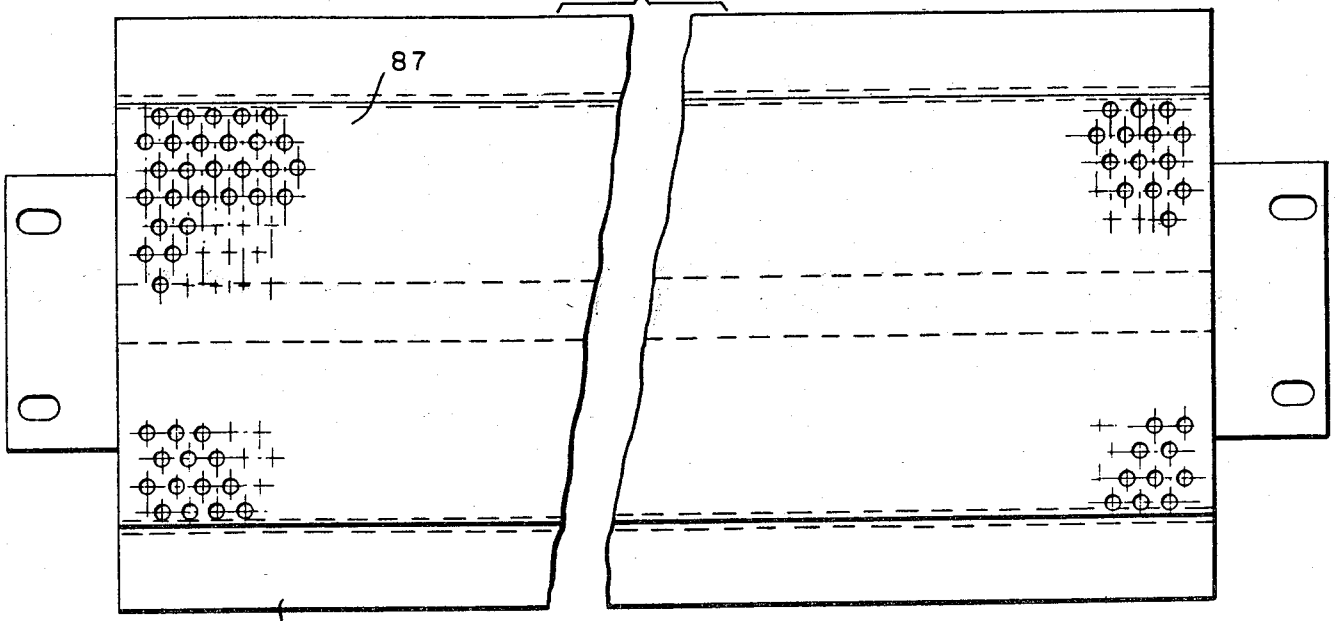
FIGS. 10 and 11 are views similar to FIGS. 6 and 7 showing an alternate embodiment of the invention using a perforated sheet as a film support element.
Figure 11:
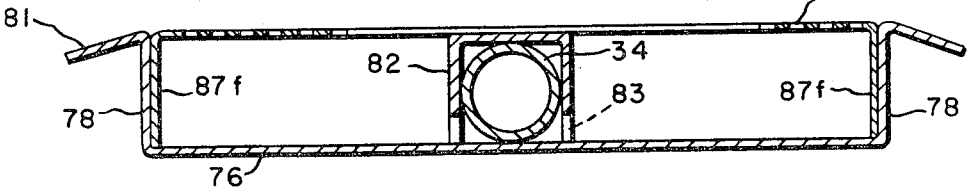

In an alternate and preferred embodiment illustrated in FIGS. 10 and 11, a perforated metal sheet 87 is used instead of the thread 86 to provide support for a transported film sheet. The preferred material for the sheet 87 is type 316 stainless steel twenty gauge sheeting having perforations of one-eighth inch diameter staggered at three-sixteenth inch centers, resulting in forty percent open area. It has been found that using the metal sheet 87 as a support rather than the thread support tends to produce a cleaner back side on the processed film. The sheet 87 extends lip-to-lip of the pan to provide a support for a film sheet being transported along the path 18. In FIG. 11, the end walls 78 of the pan 28 extend at substantially a ninety degree angle to the bottom wall 76 thereof. It should be noted in the embodiment shown in FIGS. 10 and 11 that drain holes 77 are still provided in the bottom 76 of the pan, but the drain holes are omitted from FIG. 10 for clarity of illustration. The sheet 87 has flaps 87f which closely fit to the walls 78 of the pan. The top of the housing 82 lies close to (or may abut, if desired) the undersurface of the sheet 87. The sheet 87 may be attached to the pan by any suitable means, as by spot welding.

The apparatus is readied for operation by activating pumps 32,35,48,52 as well as the supply of water to section 14, energizing elements 42,51,57, activating dryer 16 and energizing the drive for rolls 20,22. The liquids are maintained at a constant temperature which, depending on the type of photosensitive film sheet being processed, is in the range of 50–125° F. Thus, in some processes, the devices 42,51, 57 are heaters and, in others, it will be necessary to cool the liquids below room temperature. When the apparatus is ready, a film sheet can then be inserted into the nip between the first pair of rolls 19,20 and advanced along path 18. Developing solution flows from applicators 24,26 to the image-bearing surface of the film sheet. The solution is spread and agitated by the screen portion 69 on applicator 24. The back side of the film sheet is wet by solution splashed thereto from pan 28. In section 14, both sides of the film sheet are washed. When the apparatus is inactivated, liquids remaining in the troughs and pans flow out through the drain holes 70,77.

The apparatus is particularly useful in the processing of wide films having an emulsion of a silver halide coated on one side. A typical example is a film used in aerial photography and provided with an antihalation layer on its back side. With the apparatus disclosed herein, such films can be processed effectively, with a high degree of transverse and longitudinal uniformity, in total access periods of about thirty seconds. An added advantage is that the developed films also exhibit increased maximum density and a higher gradient.

It has been noted above that the ramps 66 terminate in close proximity to path 18 and that the ends of the ramps on two of the applicators are closely adjacent idler rolls 19. In tests with the wide films mentioned above, having thicknesses of 4–7 mils, the distance between rolls 19 and the first ramps 66 in sections 10,12 was 20 mils and the flows of liquids were such as to fill the gaps without creating pools on the ramps. The lips of all ramps and the planar portion 69 of screen 68 were spaced at 15 mils from path 18. All liquids were heated to a temperature of about 110° F. Momentary lingering of spent or stale developer along the center of the film sheet was avoided by the spreading and agitating activity of the screen 68 on applicator 24. Thus, the developer first in contact with the film sheet is renewed continuously and this renewal minimizes density irregularities due to aging or exhaustion of the processing liquid.

Uniformity of development longitudinally of the film is enhanced by the manner in which the screens 60 and layers 72 break up flow patterns such as those from the spaced perforations p in the dribble bars. Irregular development patterns transversely of the films are avoided both by uniformity in the layers 72 flowing from the applicators and by activity of the screen portion 69 below the applicator 24.

As the developer in pool 74 (FIG. 5) flows over the edges of the film sheet, it has a tendency to wet the back side irregularly adjacent its edges. If allowed to dry and oxidize, the back side would become spotted and stained as a consequence of such wetting. With the apparatus disclosed herein, the back of the film sheet is wet sufficiently that it does not have an opportunity to dry before reaching fixer section 12 where any developing solution on the back side is neutralized by the fixing solution in pan 28f. Antihalation dyes are also removed by the fixer solution. In section 14, residual salts formed from the processing liquids are washed away. The angularity of the spaced reaches of support thread 86 (FIGS. 6 and 9) and their wiping action across the back side avoid the possibility of visible striations on any developed film which had an antihalation layer or the like on its back side.

Although two applicators have been shown in each of sections 10,12, there are photosensitive film sheets and processes with which but a single application of developer and/or fixer is required. While the apparatus has been described in connection with the processing of conventional silver halide films, it is also useful in the applications of tanning solutions or other processing liquids to imagebearing, photosensitive film sheets.

What is claimed as new and desired to be secured by Letters Patent is:

1. In an apparatus including a section for applying a processing liquid to a photosensitive film sheet, entry and exit rolls for transporting a film sheet therethrough and an elongated trough located above and extending transversely of the path of transport, a foraminous sheet extending lengthwise of the trough, an elongated distribution bar above the trough and conduit means connected to the bar for delivery of processing liquid thereto, said bar having perforations directed at the foraminous sheet for discharging liquid thereto, said trough having one longitudinal edge lower than the other and an integral, angularly disposed ramp projecting downwardly from said one edge, said ramp terminating in close proximity to said path.

2. The apparatus of claim 1 wherein the terminal end of said ramp is bent back to present a rounded lip closely adjacent said path.

3. The apparatus of claim 2 wherein said lip is in close proximity to said entry roll.

4. The apparatus of claim 1 wherein said foraminous sheet extends from edge-to-edge in covering relationship to the trough.

5. The apparatus of claim 4 wherein is provided a second foraminous sheet extending transversely of, above and in close proximity to said path, beneath said trough.

6. The apparatus of claim 1 wherein is provided a pan extending transversely of and beneath said path and conduit means connected to the pan for delivery of processing liquid thereto, said pan having longitudinal edges bent back to present overflow lips for said liquid.

7. The apparatus of claim 6 wherein angularly disposed lengths of thread extend from lip-to-lip of said pan to provide a support for a film sheet being transported along said path.

8. The apparatus of claim 7 wherein is provided a second foraminous sheet extending transversely of and above said path, beneath said trough.

9. The apparatus of claim 6 wherein a perforated sheet extends from lip-to-lip of said pan to provide a support for a film sheet being transported along said path.

10. The apparatus of claim 9 wherein is provided a second foraminous sheet extending transversely of and above said path, beneath said trough.

* * * * *